US010458107B2

(12) United States Patent
Godines

(10) Patent No.: US 10,458,107 B2
(45) Date of Patent: Oct. 29, 2019

(54) DROP-ACTUATED FLUSH MECHANISM FOR A TOILET

(71) Applicant: Jorge Luis Godines, La Paz (MX)

(72) Inventor: Jorge Luis Godines, La Paz (MX)

( * ) Notice: Subject to any disclaimer, the term of this patent is extended or adjusted under 35 U.S.C. 154(b) by 0 days.

(21) Appl. No.: 15/221,593

(22) Filed: Jul. 27, 2016

(65) Prior Publication Data

US 2017/0030063 A1 Feb. 2, 2017

Related U.S. Application Data

(60) Provisional application No. 62/197,352, filed on Jul. 27, 2015.

(51) Int. Cl.

| | |
|---|---|
| ***E03D 1/36*** | (2006.01) |
| ***E03D 1/32*** | (2006.01) |
| ***E03D 11/18*** | (2006.01) |
| *E03D 1/33* | (2006.01) |

(52) U.S. Cl.

CPC ..... *E03D 1/36* (2013.01); *E03D 1/32* (2013.01); *E03D 11/18* (2013.01); *E03D 1/33* (2013.01)

(58) Field of Classification Search

CPC .... E03D 1/32; E03D 1/33; E03D 1/36; E03D 11/18

USPC ..... 4/434

See application file for complete search history.

(56) References Cited

U.S. PATENT DOCUMENTS 2,817,092 A * 12/1957 Hahn ..... E03D 7/00 4/254

6,668,391 B1 * 12/2003 Lee ..... E03D 11/02 4/337

9,145,668 B2 * 9/2015 Molina ..... E03D 11/13

* cited by examiner

*Primary Examiner* — Huyen Le

(57) ABSTRACT

Disclosed is a drop-actuated flush mechanism for a toilet.

8 Claims, 15 Drawing Sheets

DROP-ACTUATED FLUSH MECHANISM FOR A TOILET

The current application claims a priority to the U.S. Provisional Patent application Ser. No. 62/197,352 filed on Jul. 27, 2015.

FIELD OF THE INVENTION

The present invention generally relates to the flushing mechanism of a toilet. More specifically, the present invention is able to flush the blackwater from the toilet without a conventional water retention tank.

BACKGROUND OF THE INVENTION

The concept of a system to dislodge debris was born in Crete, Cretans had toilets with tanks fed by streams and a lever that controlled the flow of liquid and downspouts around 2000 B. C.

The way we now know the toilet was conceived by a poet. The Englishman Sir John Harrington, who in 1597 designed the most similar to modern toilet, which included a cistern, a reservoir of water in the bowl and a handle to activate the mechanism. It was dubbed "Ajax" and was installed in the palace of Queen Elizabeth II. Later in 1775, Alexander Cummins patented a new toilet cistern, which was perfected three years later by Samuel Prosse, who included a ball valve.

Seventy years later, in the English Public Health Act established that any new residence built had to have a toilet as part of its equipment; this got popular in many countries and by 1890, the toilet was more than required in Europe.

Thomas Crapper in 1884, was the one who gave the key when he invented the "floating", a device that automatically shuts off the flow of water once the tank is full. Versions of the floating valve that Crapper invented are still in use.

With the traditional toilet, we have a number of disadvantages that go unnoticed by us; slow and complex fecal elimination produces in the future colon cancer, appendicitis, and intestinal inflammation. It does not protect the nerves that control the bladder and uterus and the ileocecal valve is not sealed as it should. This valve is located between the colon and small intestine. Since it lacks support, a leak of fecal material occurs contaminating the small intestine. The shape of the conventional toilet (due to the posture the user is forced into) causes tension that can cause hernias, diverticulitis, and pelvic organ prolapse, also promotes the formation of varicose veins problems.

DETAILED DESCRIPTION OF THE INVENTION

Figure 1:
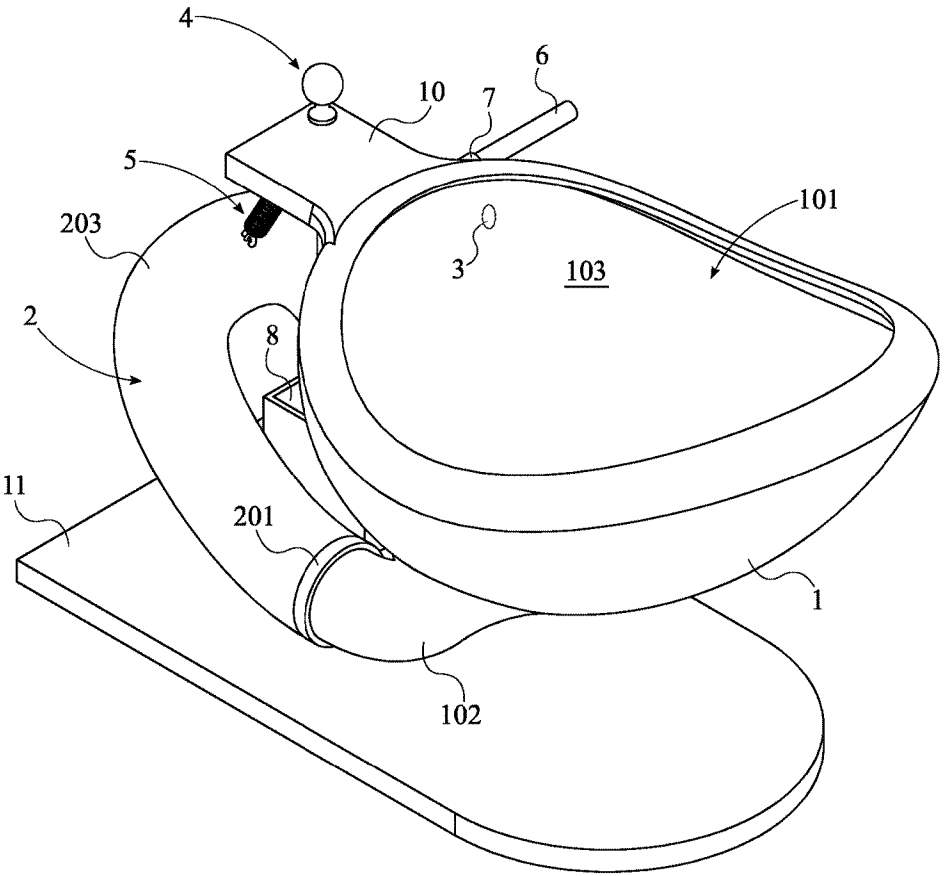
FIG. 1 is a front top perceptive view of a first embodiment of the present invention, wherein the first embodiment uses a pull knob for the flush initiation mechanism.
Figure 2:
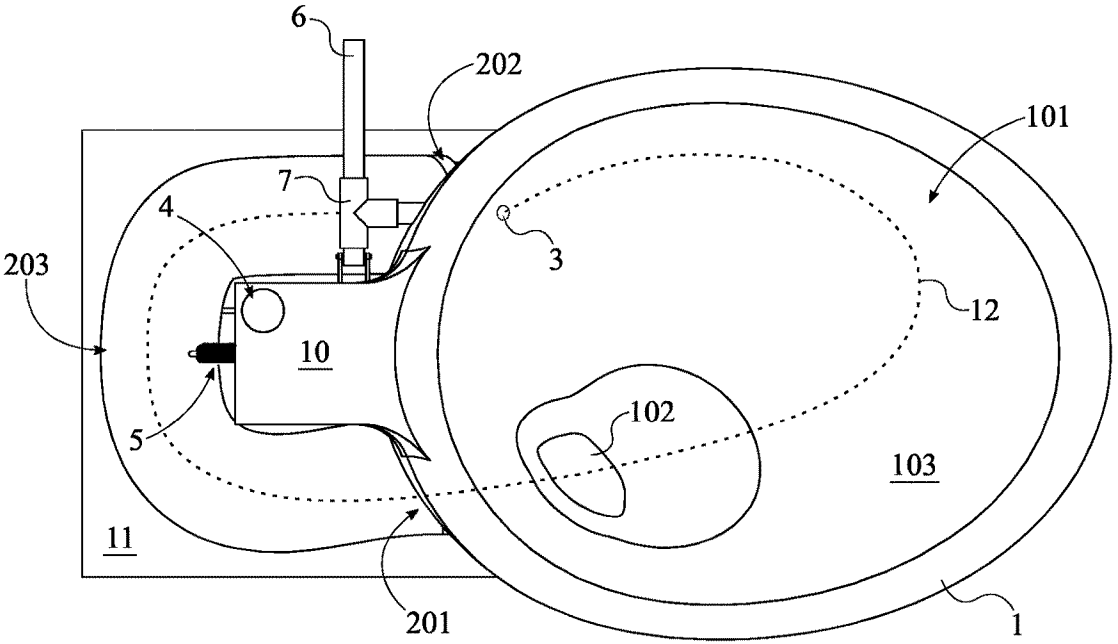
FIG. 2 is a top view of the first embodiment of the present invention.
Figure 3:
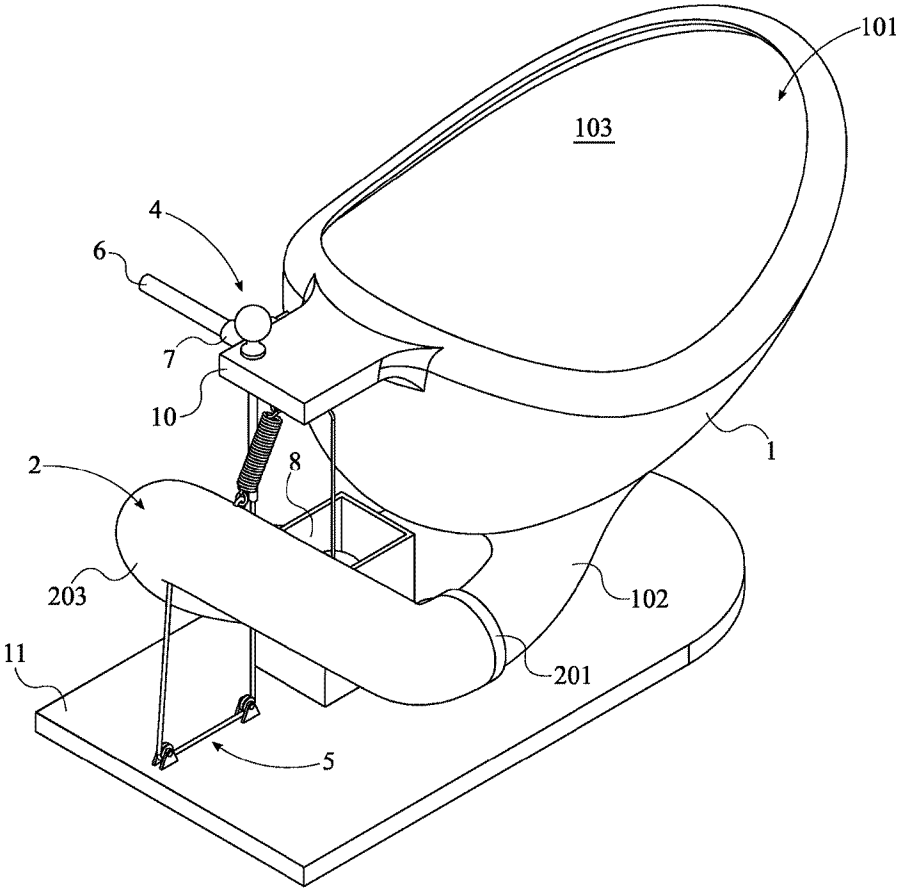
FIG. 3 is a rear top perspective view of the first embodiment of the present invention with the lax hose in a raised position.
Figure 4:
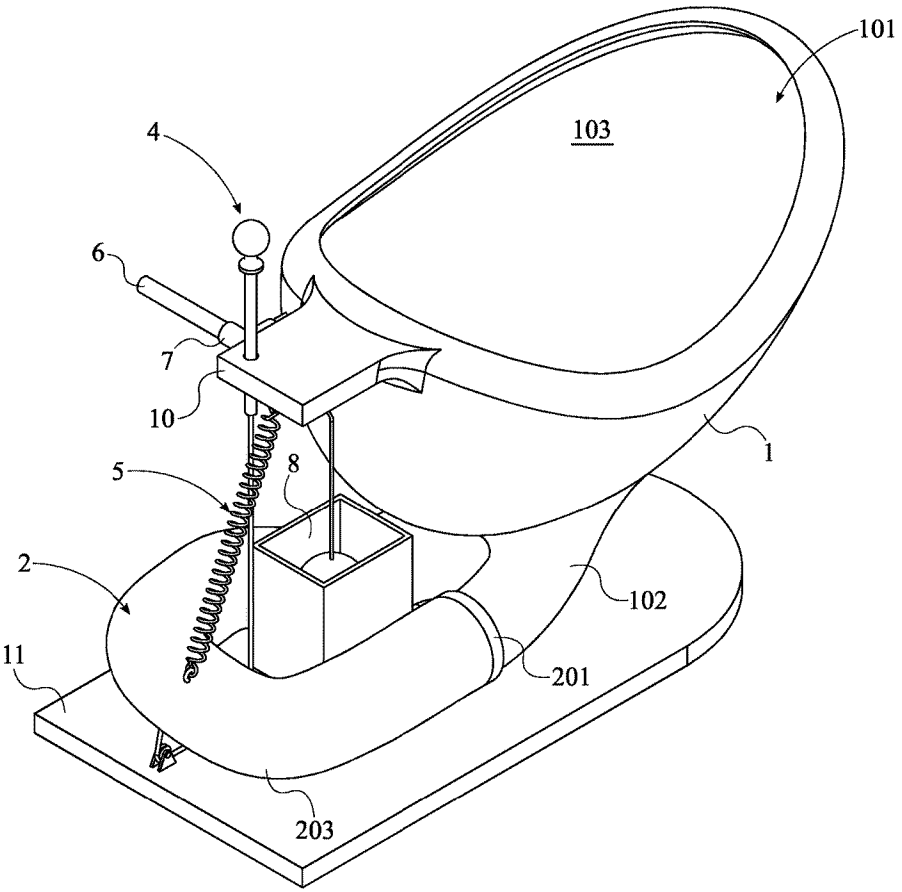
FIG. 4 is a rear top perspective view of the first embodiment of the present invention with the lax hose in a lowered position.

All illustrations of the drawings are for the purpose of describing selected versions of the present invention and are not intended to limit the scope of the present invention.

The present invention is a drop-actuated flush mechanism for a toilet so that the toilet is able to flush blackwater by altering the shape of its trapway. The present invention does not use a tank to retain readily flushable water like many conventional toilets, which allows the present invention to use much less water than a conventional toilet. The present invention is typically able to complete one flushing action with less than one liter of water. As can be seen in FIGS. 1, 2, 8, and 9, the present invention comprises a cistern 1, a lax hose 2, a filling inlet 3, a flush initiation mechanism 4, and a drop-and-retraction mechanism 5. The cistern 1 is a receptacle that is used to retain water, until the water becomes contaminated with excrement and needs to be flushed from the cistern 1. The cistern 1 comprises a receiving opening 101 and a drainage opening 102. The receiving opening 101 allows a user to deposit their excrement into the cistern 1. The receiving opening 101 is preferably designed to allow the user's posterior to engage the receiving opening 101 in a squatting position, which is also known as a natural standing fetal position. The drainage opening 102 allows blackwater to exit the cistern 1. The filling inlet 3 allows new water to flow into the cistern 1. The filling inlet 3 is integrated into the cistern 1, adjacent to the receiving opening 101, so that the new water is able to flow across and clean the internal surface 103 of the cistern 1.

The lax hose 2 is a flexible conduit that guides blackwater away from the cistern 1. The lax hose 2 is able to alter its shape so that the lax hose 2 can be used as the trapway for the toilet. The lax hose 2 comprises a first open end 201, a second open end 202, and the bight 203. The first open end 201 and the second open end 202 are the two opposing ends of the lax hose 2. The first open end 201 is in fluid communication with the drainage opening 102 so that blackwater from the cistern 1 is able to travel through the first open end 201, through the bight 203, and out of the second open end 202. The bight 203 is a curve in the lax hose 2 between the first open end 201 and the second open end 202 and is used to form the trapway for the toilet.

As can be seen in FIGS. 3, 4, 10, and 11, the drop-and-retraction mechanism 5 is used to move the bight 203 between a raised position and a lowered position. When the bight 203 is in the raised position, water fills the portion of the bight 203 adjacent to the first open end 201 to the same level as the water within the cistern 1. This is according to the communicating vessels effect, which states that if a set of containers is retaining a homogeneous fluid, then the homogeneous fluid will settle at the same level in all of the containers regardless of the individual shape or individual volume of each container. When the bight 203 is the lowered position, the water retained by the portion of the bight 203 adjacent to the first open end 201 and the water retained by the cistern 1 is suctioned out of present invention through the second open end 202. This is because of Pascal's law, which states that pressure exerted anywhere in a confined incompressible fluid is transmitted equally in all directions throughout the confined incompressible fluid such that the pressure variations (initial differences) remain the same. Following Pascal's law, the pressure within the sewage line that is in fluid communication with the second open end 202 is less than the pressure within the lax hose 2, which creates the suction that draws the blackwater out of the cistern 1, through the lax hose 2, and into the sewage line. Once the bight 203 is returns to the raised position, the portion of the bight 203 adjacent to the first open end 201 and the cistern 1 can be refilled with water to the same level by the filling inlet 3. Thus, the drop-and-retraction mechanism 5 needs to be operatively coupled to the bight 203 so that the drop-and-retraction mechanism 5 can be used to lower the bight 203 in order to flush blackwater out of the cistern 1 and can be used to raise the bight 203 in order to refill the cistern 1 with new water. In addition, the flush initiation mechanism 4 allows a user to actuate the drop-and-retraction mechanism 5 and consequently needs to be operatively coupled to the drop-and-retraction mechanism 5.

Figure 7A:
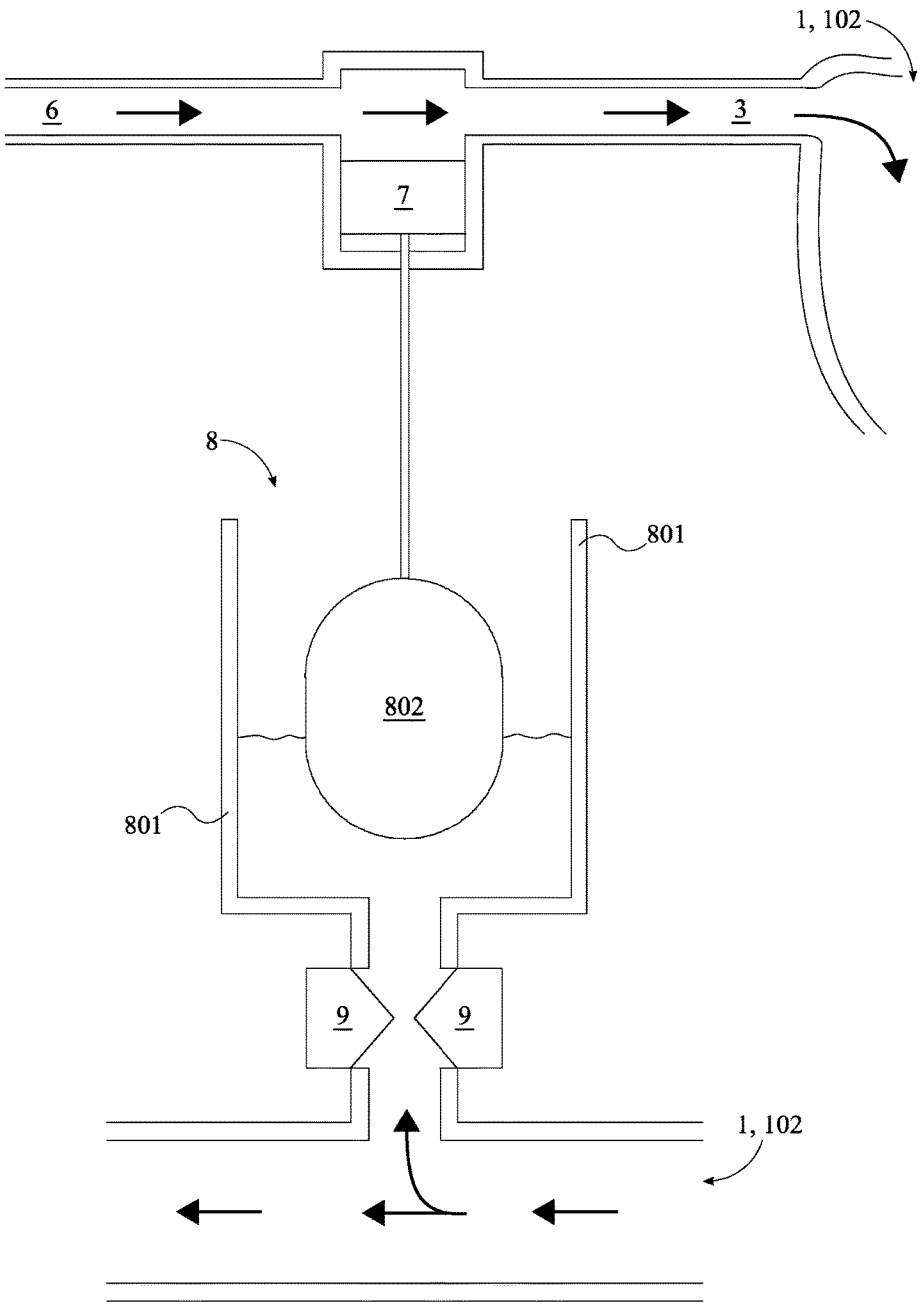
FIG. 7A is a schematic view of the float-actuated trigger with the fill valve opened between the external water supply and the filling inlet.
Figure 7B:
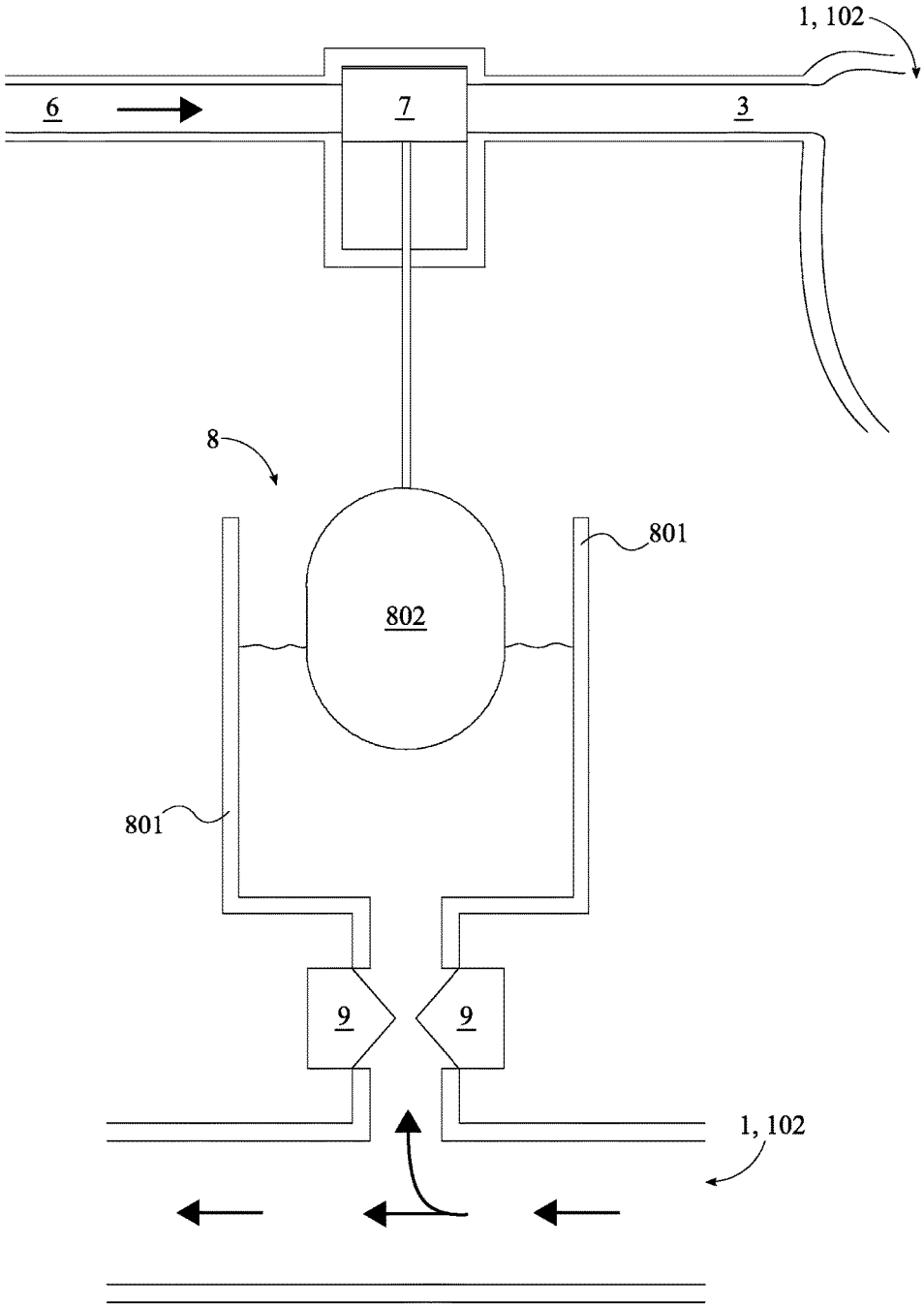
FIG. 7B is a schematic view of the float-actuated trigger with the fill valve closed between the external water supply and the filling inlet.
Figure 8:
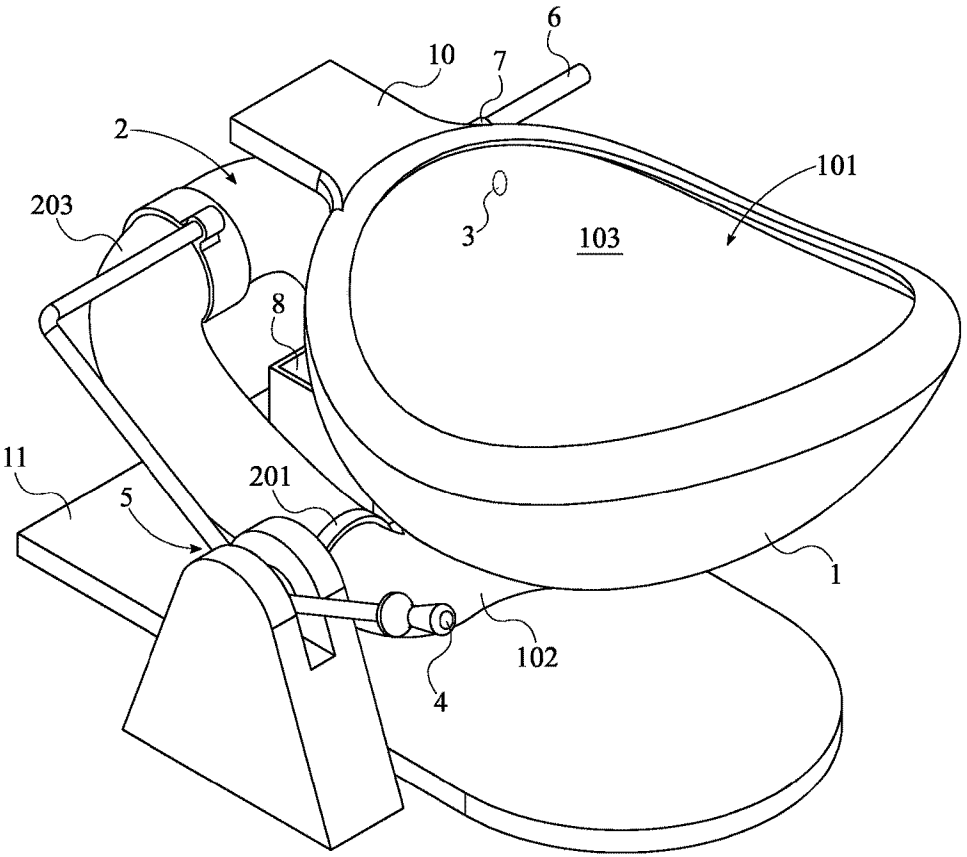
FIG. 8 is a front top perceptive view of a second embodiment of the present invention, wherein the first embodiment uses a pull lever for the flush initiation mechanism.
Figure 9:
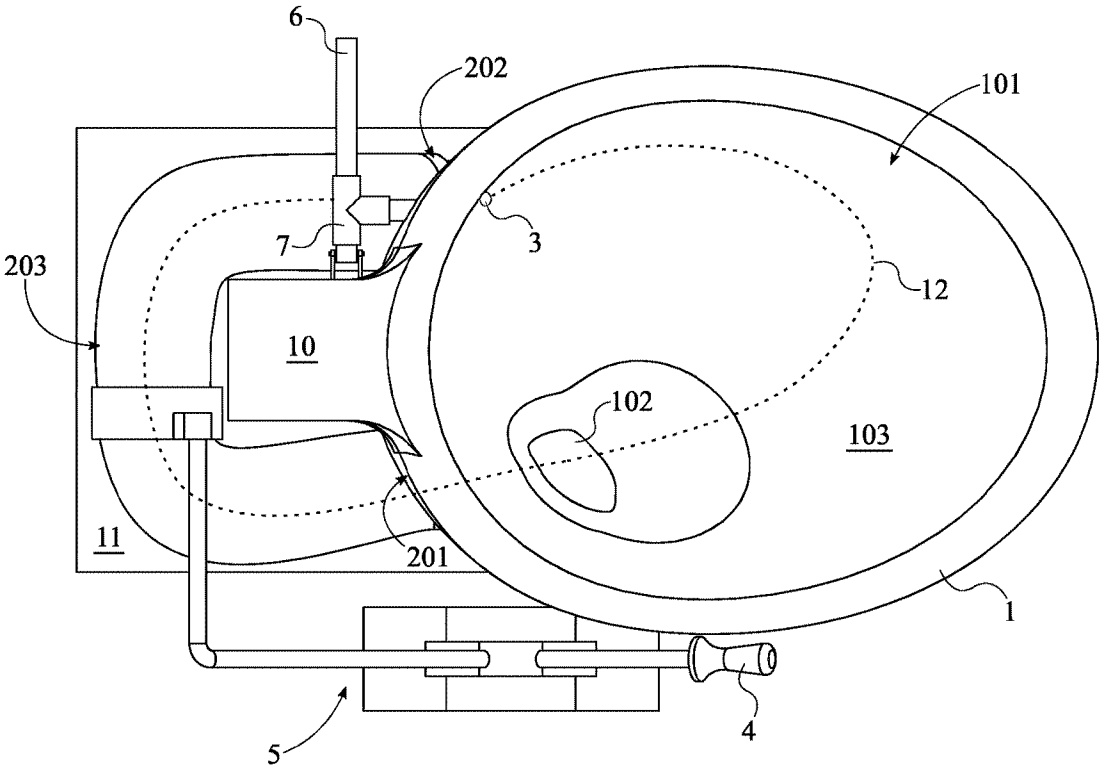
FIG. 9 is a top view of the second embodiment of the present invention.
Figure 10:
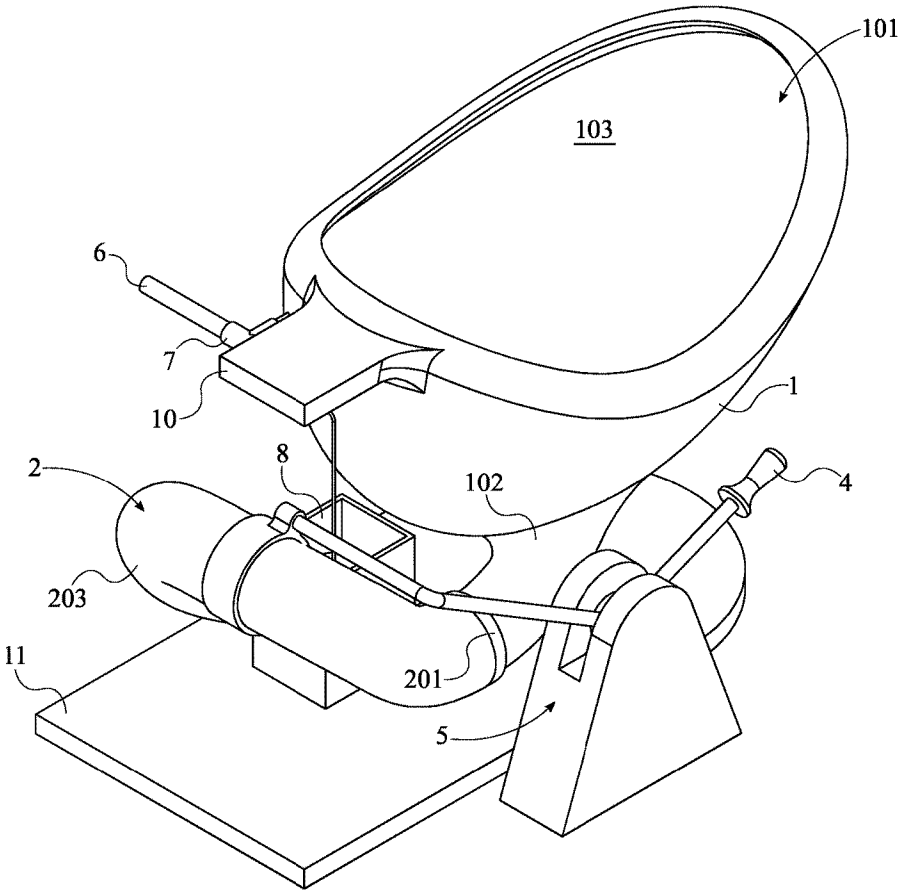
FIG. 10 is a rear top perspective view of the second embodiment of the present invention with the lax hose in a raised position.
Figure 11:
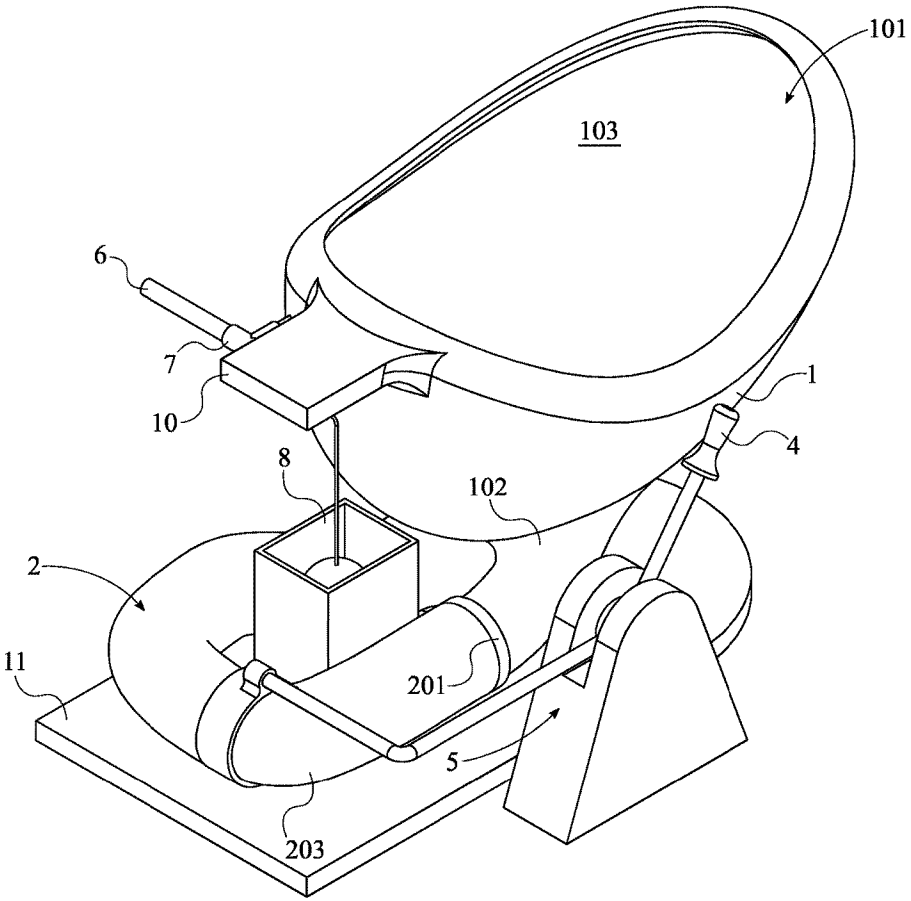
FIG. 11 is a rear top perspective view of the second embodiment of the present invention with the lax hose in a lowered position.

As can be seen in FIGS. 7A and 7B, the present invention may further comprise a float-actuated trigger 8 and a fill valve 7, which are used to regulate when and how much water flows from the filling inlet 3 into the cistern 1. The fill valve 7 is used to selectively close off the filling inlet 3 from an external water supply line 6. Thus, an external water supply line 6 is in fluid communication with the filling inlet 3 through the fill valve 7. The float-actuated trigger 8 either opens or closes the fill valve 7 based on the current water level within the cistern 1 and consequently is in fluid communication with the cistern 1, adjacent to the drainage opening 102. The float-actuated trigger 8 is operatively coupled to the fill valve 7 so that the float-actuated trigger 8 can open the fill valve 7 when the cistern 1 needs to be refilled with new water, which occurs after the bight 203 is dropped to the lowered position. The float-actuated trigger 8 is also operatively coupled to the fill valve 7 so that the float-actuated trigger 8 can close the fill valve 7 when cistern 1 has been refilled with the required amount of new water, which occurs after the bight 203 is retracted to the raised position. In addition, a choking device 9 can be in fluid communication between the cistern 1 and the float-actuated trigger 8 so that the choking device 9 is able to prevent blackwater from flowing into the float-actuated trigger 8 before the bight 203 is dropped to the lowered position. The additional viscosity of blackwater and the debris from the blackwater may reduce the functionality of the float-actuated trigger 8. In some embodiments of the present invention, the float-actuated trigger 8 is operatively coupled to the flush initiation mechanism 4 in order to reset the flush initiation mechanism 4 for when the user needs to again flush black water from the cistern 1.

A specific embodiment of the float-actuated trigger 8 comprises a chamber 801 and a buoyant body 802. The buoyant body 802 is positioned within the chamber 801 so that the buoyant body 802 is able to float on the water held within the chamber 801. The water held within the chamber 801 flows in from the cistern 1, and, consequently, the chamber 801 needs to be in fluid communication with the cistern 1. The water held within the chamber 801 is proportionate to how much water needs to flow from the filling inlet 3 into the cistern 1 in order to reach the required amount of new water. The buoyant body 802 moves upwards through the chamber 801 as the cistern 1 gets closer to being refilled with the required amount of new water. Thus, the buoyant body 802 needs to be operatively coupled to the fill valve 7 so that the linear movement of the buoyant body 802 within the chamber 801 is able to either open or close the fill valve 7 based on the current water level with the cistern 1.

Figure 5:
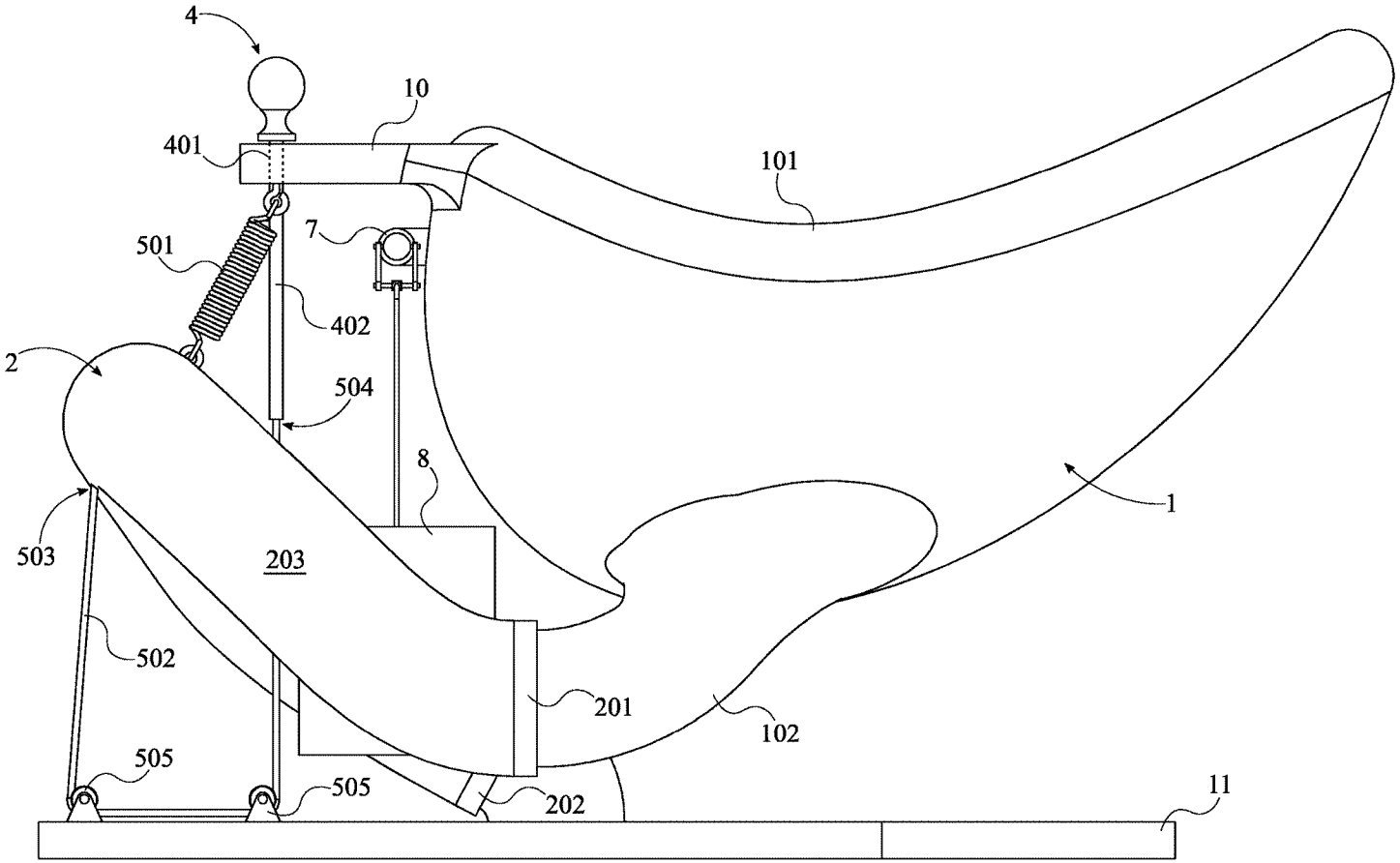
FIG. 5 is a side perspective view of the first embodiment of the present invention with the lax hose in a raised position.
Figure 6:
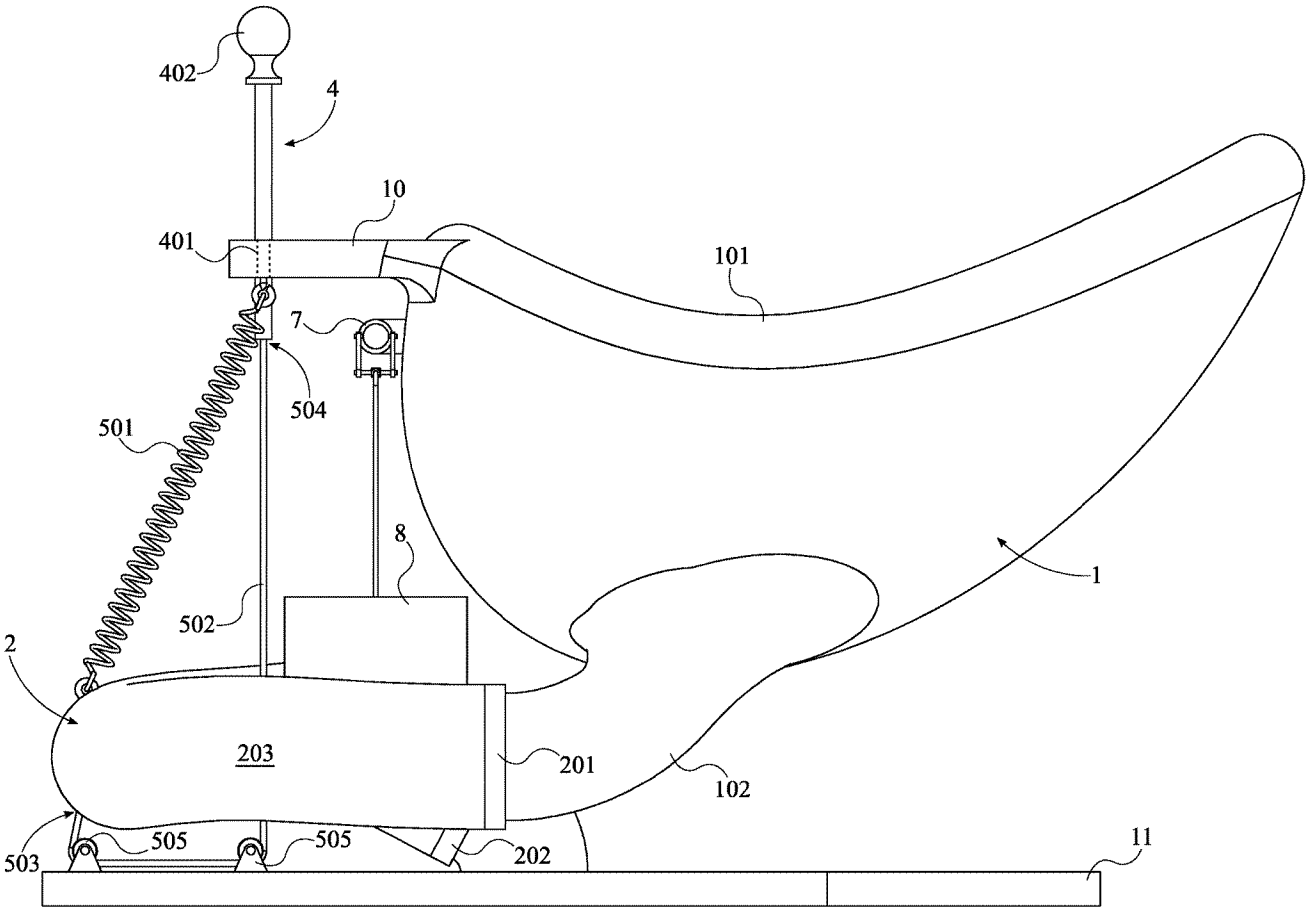
FIG. 6 is a side perspective view of the first embodiment of the present invention with the lax hose in a lowered position.

The drop-and-retraction mechanism 5 and the flush initiation mechanism 4 can be configured into many different embodiments. In one specific embodiment illustrated in FIGS. 5 and 6, the drop-and-retraction mechanism 5 comprises a tension spring 501, a cable 502, and a system of pulleys 505, and the flush initiation mechanism 4 comprises a knob stop 401 and a pull knob 402. The present invention also needs to further comprise an upper fixture 10 and a lower fixture 11, which act as structural bases to mount the aforementioned components of the drop-and-retraction mechanism 5 and the flush initiation mechanism 4. The upper fixture 10 and the lower fixture 11 are positioned offset from each other so that the bight 203 can be positioned in between the upper fixture 10 and the lower fixture 11 and is able to move from its raised position to its lowered position without any mechanical complications. The bight 203 is retractably coupled to the upper fixture 10 by the tension spring 501 because the tension spring 501 constantly applies a force to retract the bight 203 to its raised position. The knob stop 401 is a hole used to hold the pull knob 402 in place until the user decides to actuate the drop-and-retraction mechanism 5 with the pull knob 402. The knob stop 401 is integrated through the upper fixture 10 so that the pull knob 402 is situated in an area of the present invention that is easily accessible to the user. The system of pulleys 505 guides the tension of the cable 502 in order to move the bight 203 to its lowered position and is mounted onto the lower fixture 11. The cable 502 guides the movement of the bight 203 to its lowered position by being tensionably engaged to the system of pulleys 505. In addition, a first cable end 503 of the cable 502 is laterally connected to the bight 203, opposite to the tension spring 501, and the second cable end 504 of the cable 502 is connected to the pull knob 402 so that the first cable end 503 is able to pull the bight 203 to its lowered position when the user pulls on the pull knob 402.

Figure 12:
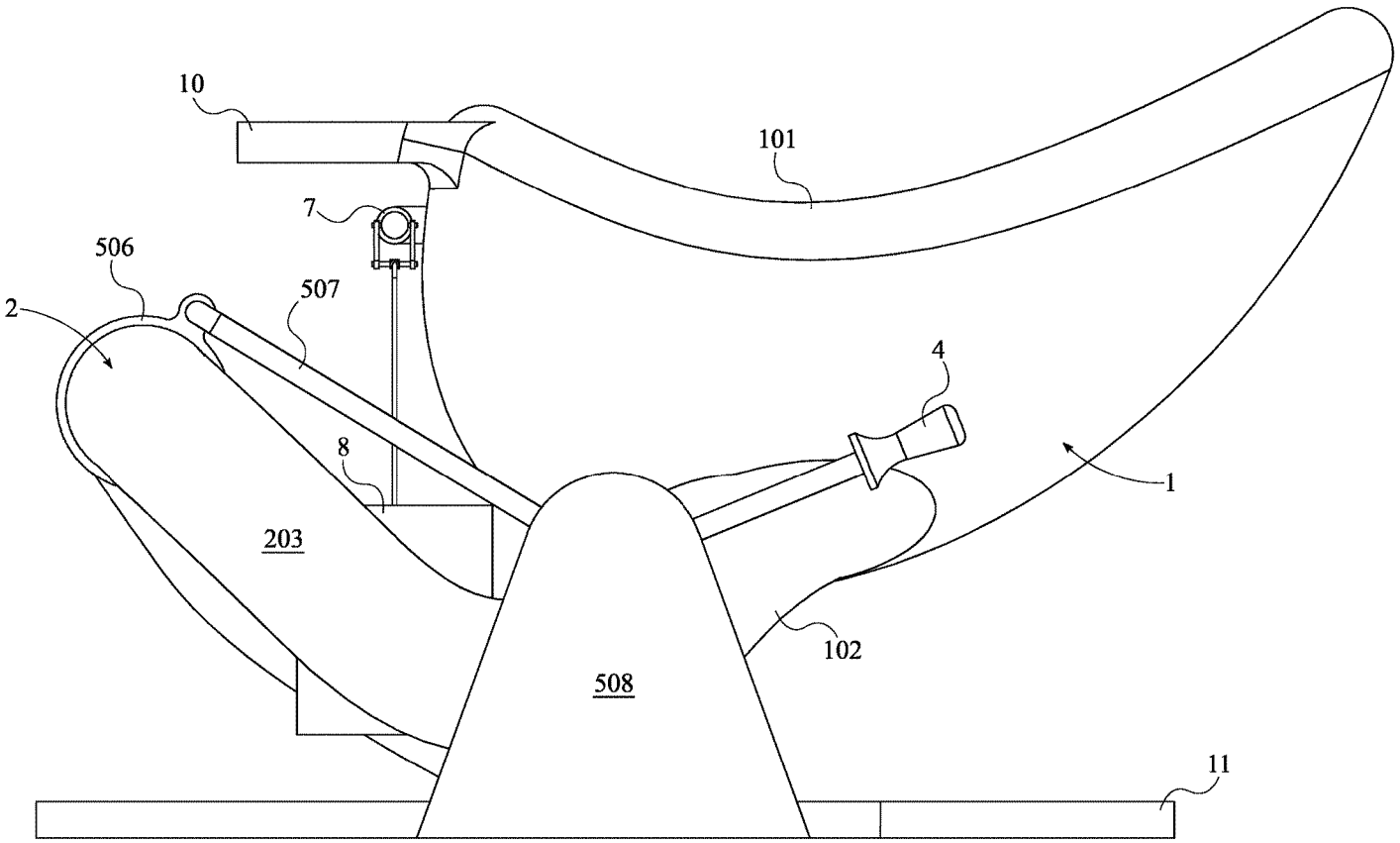
FIG. 12 is a side perspective view of the second embodiment of the present invention with the lax hose in a raised position.
Figure 13:
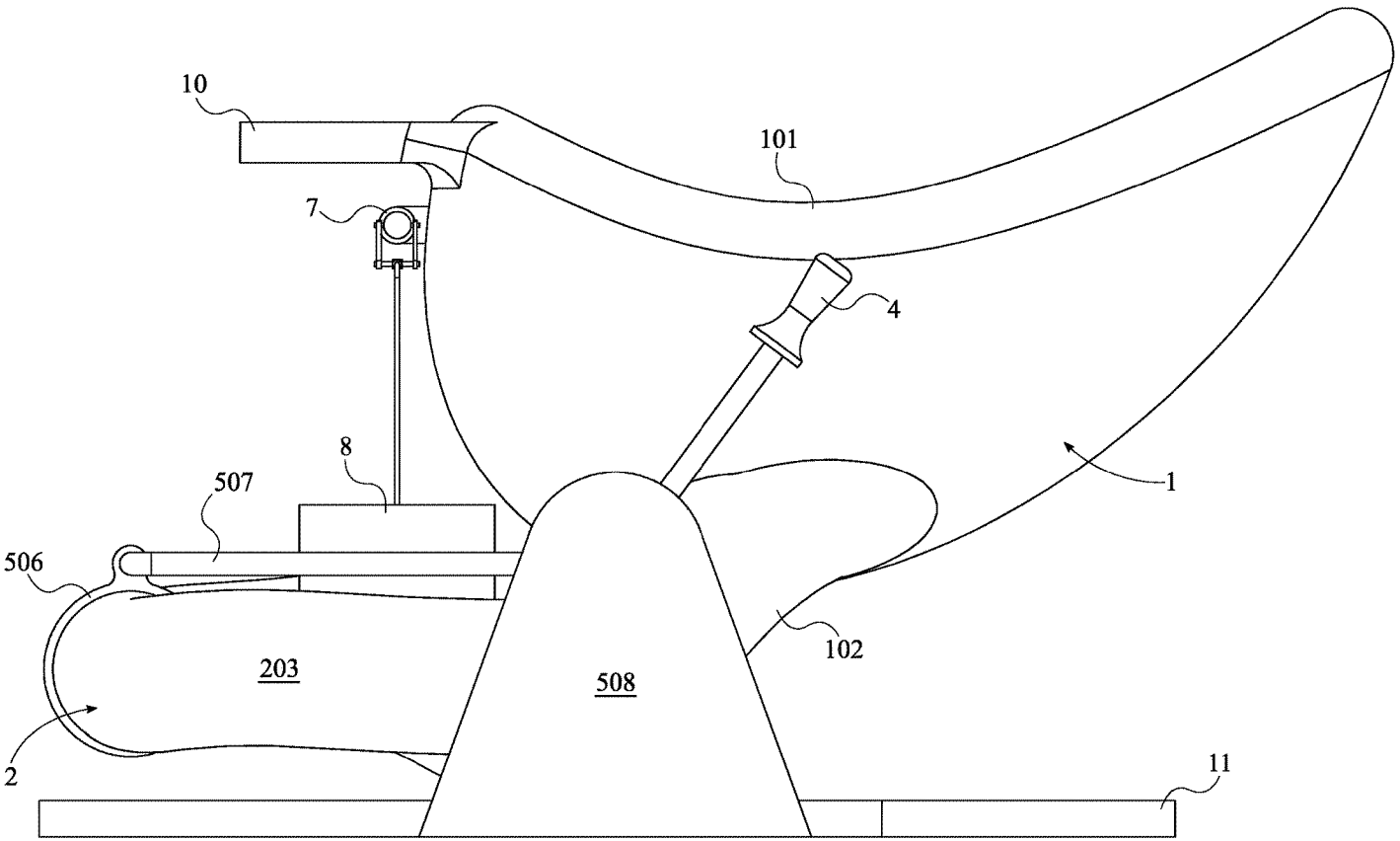
FIG. 13 is a side perspective view of the second embodiment of the present invention with the lax hose in a lowered position.

In another specific embodiment illustrated in FIGS. 12 and 13, the drop-and-retraction mechanism 5 comprises a lever 507 and a brace 506. The present invention also needs to further comprise a lower fixture 11, which acts as a structural base for the aforementioned components of the drop-and-retraction mechanism 5. The brace 506 is laterally position to the bight 203 and is used to either pull or push the bight 203 to its lowered position. The brace 506 is terminally connected to the lever 507 so that the lever 507 is able to actuate the movement of the brace 506 and consequently guides the movement of the bight 203. A fulcrum 508 of the lever 507 is positioned opposite to the brace 506, along the lever 507, and is mounted onto the lower fixture 11. The configuration of the brace 506 and the lever 507 prevents mechanical interference with the movement of the bight 203 while efficiently guiding the movement of the bight 203. The flush initiation mechanism 4 needs to be operative coupled to the lever 507 so that the lever 507 is actuated when the flush initiation mechanism 4 is actuated by the user. For example, the flush initiation mechanism 4 for this specific embodiment could be a handle that is fixed to the lever 507 at an angle and is pushed forward to move the bight 203 to its raised position. In addition to the specific embodiment, the drop-and-retraction mechanism 5 and the flush initiation mechanism 4 is configured to automatically retract the bight 203 to its raised position. For example, a counterweight or a tension spring that is connected to either the brace 506, the lever 507, or the flush initiation mechanism 4 could be used to automatically retract the bight 203 to its raised position. Another example is a torsion spring could be mechanically integrated into the fulcrum 508 of the lever 507 so that the lever 507 automatically retracts the bight 203 to its raised position.

In another specific embodiment, the drop-and-retraction mechanism 5 and the flush initiation mechanism 4 can be actuated with electronic switches, electronic servos, and other electronic mechanisms.

The configuration of the cistern 1 and the lax hose 2 while the bight 203 is in its raised position allows the present invention to take advantage to the Ekman spiral effect to more effectively flush blackwater out of the cistern 1. The Coriolis effect is a deflection of a moving object when the motion of the moving object is described relative to a rotating reference frame. In a reference frame with a clockwise rotation, the deflection is to the left of the motion of the moving object. In a reference frame with a counter-clockwise rotation, the deflection is to the right of the motion of the moving object. The Ekman spiral effect is a consequence of the Coriolis effect. As an example, when surface water molecules are moved by the wind, the surface water molecules drag deeper layers of water molecules below them. Like surface water molecules, the deeper water molecules are deflected by the Coriolis effect to the right in the Northern Hemisphere and are deflected to the left in the Southern Hemisphere. As a result, each successive deeper layer of water molecules moves more slowly to the right or the left, which creates a spiral effect. When the bight 203 is in its lowered position, the Ekman spiral effect is applied to the present invention because the cistern 1 and the lax hose 2 are configured to allow a helical path for fluid flow 12 from the filling inlet 3, across the internal surface 103 of the cistern 1, through the drainage opening 102, through the first open end 201, through the bight 203, and to the second open end 202. The helical path for fluid flow 12 allows the new water from the filling inlet 3 to better clean any debris left over from the blackwater of the previous flushing action.

Figure 14:
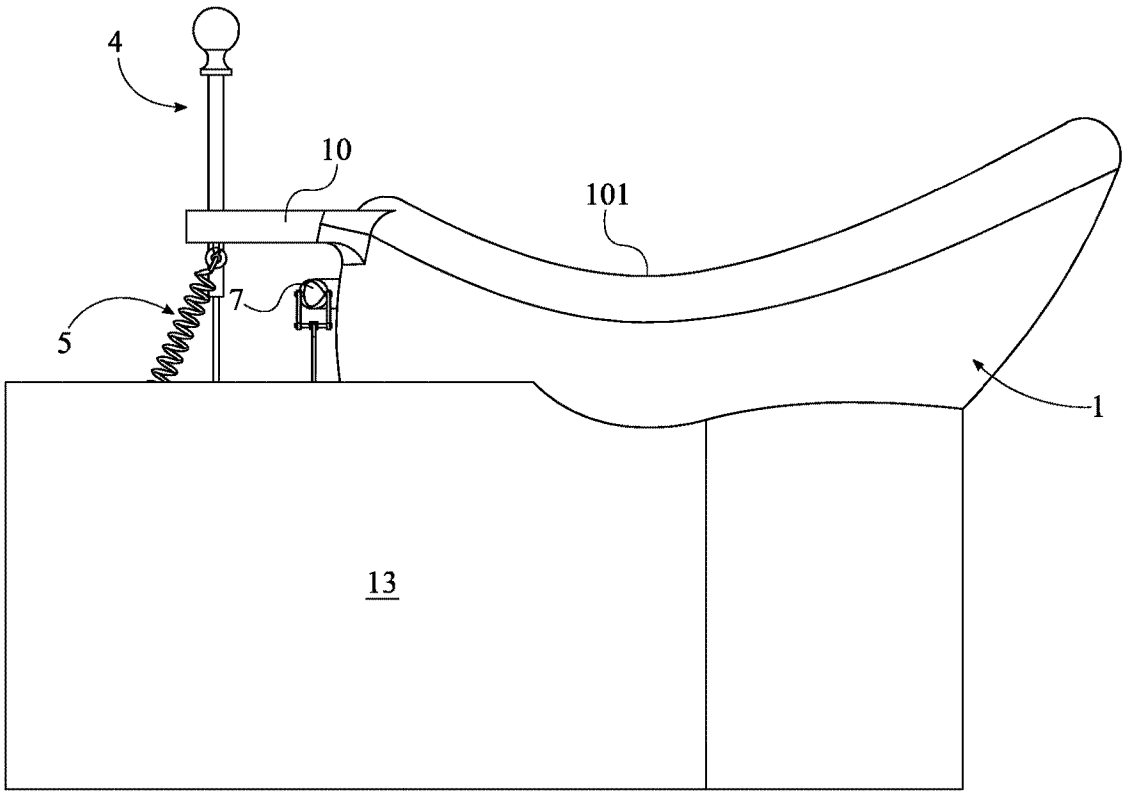
FIG. 14 is a side perspective view of the first embodiment of the present invention with the skirt.

The present invention may include some ancillary features that improve the overall functionality of the present invention. As can be seen in FIG. 14, one such feature is a skirt 13 that is mounted about the lax hose 2 and the drop-and-retraction mechanism 5, which protects the lax hose 2 and the drop-and-retraction mechanism 5 from external objects mechanically interfering with the functional movement of the lax hose 2 and the drop-and-retraction mechanism 5. Another such feature is electronic components such as USB devices, speakers, microphone, Bluetooth, WiFi, voice recognition module to activate the toilet (touchless flush) and/or lifting the seat, personalized voice profiles, waterproof multifunction touchpad, user detection module (such as infrared sensor) to lift the seat automatically by proximity.

Although the invention has been explained in relation to its preferred embodiment, it is to be understood that many other possible modifications and variations can be made without departing from the spirit and scope of the invention as hereinafter claimed.

What is claimed is:

1. A drop-actuated flush mechanism for a toilet comprises:
- a cistern;
- a lax hose;
- a filling inlet;
- a flush initiation mechanism;
- a drop-and-retraction mechanism;
- an external water supply line;
- a fill valve;
- a float-actuated trigger;
- said cistern comprises a receiving opening and a drainage opening;
- said lax hose comprises a first open end, a second open end, and a bight;
- said filling inlet being integrated into said cistern, adjacent to said receiving opening;
- said drainage opening being in fluid communication with said first open end;
- said flush initiation mechanism being operatively coupled to said drop-and-retraction mechanism, wherein said flush initiation mechanism is used to actuate said drop-and-retraction mechanism;
- said drop-and-retraction mechanism being operatively coupled to said bight, wherein said drop-and-retraction mechanism is used to lower said bight in order to flush said cistern and is then used to raise bight in order to refill said cistern;
- said external water supply line being in fluid communication with said filling inlet through said fill valve;
- said float-actuated trigger being in fluid communication with said cistern, adjacent to said drainage opening; and
- said float-actuated trigger being operatively coupled to said fill valve, wherein said float-actuated trigger is used to open said fill valve while said cistern is refilling with new water and is used to close said fill valve after said cistern is refilled with said new water.

2. The drop-actuated flush mechanism for a toilet as claimed in claim 1 comprises:
- a choking device; and
- said choking device being in fluid communication between said cistern and said float-actuated trigger.

3. The drop-actuated flush mechanism for a toilet as claimed in claim 1 comprises:
- said float-actuated trigger being operatively coupled to said flush initiation mechanism, wherein said float-actuated trigger is used to reset said flush initiation mechanism.

4. The drop-actuated flush mechanism for a toilet as claimed in claim 1 comprises:
- said float-actuated trigger comprises a chamber and a buoyant body;
- said chamber being in fluid communication with said cistern;
- said buoyant body being positioned within said chamber; and said buoyant body and said fill valve being operatively coupled to each other, wherein movement of said buoyant body within said chamber is used to either open or close said fill valve.

5. The drop-actuated flush mechanism for a toilet as claimed in claim 1 comprises:

an upper fixture;

a lower fixture;

said drop-and-retraction mechanism comprises a tension spring, a cable, and a system of pulleys;

said flush initiation mechanism comprises a knob stop and a pull knob;

said cable comprises a first cable end and a second cable end;

said upper fixture and said lower fixture being positioned offset from each other;

said bight being positioned in between said upper fixture and said lower fixture;

said bight being retractably coupled to said upper fixture by said tension spring;

said knob stop being integrated through said upper fixture;

said system of pulleys being mounted onto said lower fixture;

said cable being tensionably engaged to said system of pulleys;

said first cable end being laterally connected to said bight, opposite to said tension spring; and said second cable end being connected to said pull knob.

6. The drop-actuated flush mechanism for a toilet as claimed in claim 1 comprises:

a lower fixture;

said drop-and-retraction mechanism comprises a lever and a brace;

said brace being laterally positioned to said bight;

said brace being terminally connected to said lever;

a fulcrum of said lever being positioned opposite to said brace along said lever;

said fulcrum of said lever being mounted onto said lower fixture;

said flush initiation mechanism being operatively coupled to said lever, wherein said flush initiation mechanism is used to actuate said lever; and said drop-and-retraction mechanism and said flush initiation mechanism being configured to automatically retract said bight to a raised position.

7. The drop-actuated flush mechanism for a toilet as claimed in claim 1 comprises:

wherein said bight is in a lowered position; and said cistern and said lax hose being configured to allow a helical path for fluid flow from said filling inlet, across an internal surface of said cistern, through said drainage opening, through said first open end, through said bight, and to said second open end.

8. The drop-actuated flush mechanism for a toilet as claimed in claim 1 comprises:

a skirt; and said skirt being mounted about said lax hose and said drop-and-retraction mechanism.

* * * * *